US012228003B2

(12) United States Patent
Swinford

(10) Patent No.: US 12,228,003 B2
(45) **Date of Patent: *Feb. 18, 2025**

(54) FLUID-DRIVEN PULSING HAMMERING TOOL

(71) Applicant: Jason Swinford, Spring, TX (US)

(72) Inventor: Jason Swinford, Spring, TX (US)

(73) Assignee: Texas Oilwell Partners LLC, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/241,875

(22) Filed: Sep. 3, 2023

(65) Prior Publication Data

US 2023/0407721 A1 Dec. 21, 2023

Related U.S. Application Data

(63) Continuation-in-part of application No. 17/473,244, filed on Sep. 13, 2021, now Pat. No. 11,745,324.

(60) Provisional application No. 63/183,349, filed on May 3, 2021, provisional application No. 63/147,036, filed on Feb. 8, 2021.

(51) Int. Cl.
*E21B 31/113* (2006.01)

(52) U.S. Cl.
CPC ..... *E21B 31/113* (2013.01)

(58) Field of Classification Search
CPC . E21B 6/00; E21B 7/04; E21B 31/113; E21B 4/14; B25D 2250/245; B25D 2250/275
USPC ..... 173/117–118, 120–122, 124–133, 173/135–138, 184–189, 200–212
See application file for complete search history.

(56) References Cited

U.S. PATENT DOCUMENTS 3,568,783 A * 3/1971 Chenoweth ..... E21B 4/14 175/296
3,648,786 A * 3/1972 Chenoweth ..... E21B 21/08 91/47
3,648,787 A * 3/1972 Chenoweth ..... E21B 21/00 175/320
3,721,304 A * 3/1973 Hanson ..... E21B 7/022 173/2
4,077,304 A * 3/1978 Bouyoucos ..... B25D 9/12 91/289

(Continued)

FOREIGN PATENT DOCUMENTS

DE 202018006641 U1 * 11/2021 ..... E21B 10/36

*Primary Examiner* — Robert F Long
(74) *Attorney, Agent, or Firm* — Eric P. Mirabel

(57) ABSTRACT

A pulsating hammer tool providing longer, stronger and frequent shock waves is disclosed. Selective closure of a poppet valve and interruptions of fluid flow through sliding valve assemblies and a flow regulator valve, generates shock waves and induces opening of the poppet valve. Shock waves generated by the sliding valve assemblies and the flow regulator valve combine with those generated by opening/closing of the poppet valve resulting in waves with increased amplitude. Shape, dimensions and orientations of flow paths through flow regulator valve are chosen to impart desired frequency and magnitude to generated shock waves. Similarly, the frequency of shock waves generated by the valve assemblies can be controlled by varying lengths of the valve mid-sections and/or wash pipes, or by adjusting fluid pressure or the number and size of vents.

19 Claims, 15 Drawing Sheets

(56) References Cited

U.S. PATENT DOCUMENTS

| | | | | |
|---|---|---|---|---|
| 4,290,489 | A * | 9/1981 | Leavell | F04B 39/12 173/133 |
| 7,139,219 | B2 * | 11/2006 | Kolle | G01V 1/40 166/321 |
| 2008/0296035 | A1 * | 12/2008 | Lohmann | B25D 9/265 173/208 |
| 2015/0136405 | A1 * | 5/2015 | Mohon | E21B 4/14 166/320 |
| 2023/0407721 | A1 * | 12/2023 | Swinford | E21B 4/14 |

* cited by examiner

FLUID-DRIVEN PULSING HAMMERING TOOL

RELATED APPLICATIONS

This application is a continuation-in-part of U.S. application Ser. No. 17/473,244, filed 9-13-2021, which claims priority to US Provisional Nos. 63/183,349, filed May 3, 2021, and 63/147,036 filed Feb. 8, 2021.

BACKGROUND

In well bore operations, including drilling, pressurized fluid is pumped into coil tubing inserted into the well. The pressurized fluid can power drilling operations through a mud motor placed at the bottom hole assembly (BHA). It can also power tools placed along the drill string which can assist in freeing the drill bit or other portions of the tubing which become bound during drilling. At depths beyond about 17,000 feet, subterranean pressures are significant and frequently cause binding of the BHA or drill string, especially in directional drilling or any extended reach operations (where the drill string is turned from the vertical).

Thus, the drill string often includes jars or tools which generate hammering impacts or vibrations, to help free the stuck drill string or stuck equipment. See e.g. U.S. Pat. No. 10,508,495. Nevertheless, there is a need for tools generating stronger, longer and more frequent shock waves, for deep or extended reach drilling operations. Moreover, where coiled tubing is used as the drill string, its flexibility dampens the shock waves—increasing the need stronger, longer and more frequent shock waves in coiled tubing operations.

When pressurized fluid flow is suddenly obstructed, e.g., by valve closure, the kinetic energy of the fluid causes the fluid to be compressed in the immediate vicinity of the obstruction. The local expansion of the fluid which follows the maximum compression appears as a reversely directed pressure or shock wave that then propagates through the fluid, as a series of high and low pressure zones. This phenomenon is commonly referred to as a water hammer, even though any carrier fluids (e.g., oil) can be used to generate the same effect. Rapid opening and closing of valve(s) in a pressurized system or selectively restricting flow can generate successive, pulsating water hammering effects.

For tools which operate as successive, pulsating water hammers for drilling operations and otherwise, there is an ongoing need for such tools which exhibit an increased wave amplitude, duration and/or frequency.

SUMMARY

The invention is an improved pulsating hammer tool which continuously generates stronger, longer and frequent down hole shock waves that are stronger, longer and frequent than other extended reach tools, when water or fluid pressure is applied from a pump, preferably located at the surface.

The improved pulsating hammer tool relies on a poppet valve which prevents fluid flow directly from the interiors of two sliding valves assemblies (one inside the other) to the upper portion of the poppet valve, though there is remaining fluid communication from the upper portion of the poppet valve to the interiors of the two sliding valves assemblies through vents in the valve assemblies.

The tool also has a lower flow regulator valve which communicates with the upper portion of the poppet valve through two separate flow paths, and wherein the flow regulator valve can be selectively contacted by the outer valve assembly to restrict fluid communication with the poppet valve other than through the vents in the two sliding valves assemblies. Selective interruptions of the various flow paths described above and closing of the poppet valve generates back pressure fluid shock waves which induce opening of the poppet valve and opening and closing of the inner and outer valve assembly vents, and contact by the outer valve assembly with the flow regulator valve. Some of the shock waves generated by the two sliding valves and the lower flow regulator valve also combine with the fluid shock waves generated by the upper poppet valve resulting in constructive interference, and form waves with increased amplitude.

Different embodiments of the invention include different flow regulator valves and different regulation modes to selectively increase back pressure. One embodiment employs a Tesla valve as shown in FIGS. 1A to 2B. In another embodiment, an axial channel flow regulator valve includes one or more vents and flow channels whose dimensions, geometrical shape and orientations are selected to impart desired frequency and magnitude to shock waves generated by the tool.

In another embodiment, the pulsating hammer tool is also equipped with a flow nut on the upper end of the outer valve assembly to allow access by pressurized fluid flow into the outer and inner valve assemblies.

Selective interruptions of the fluid flow path through the outer (and inner) valve assemblies caused by closing of the poppet valve generates back pressure fluid shock waves. Closure of the poppet valve further pushes the outer valve assembly downwards to strike the upper end of the flow regulator to generate a hammering shock.

Generated back pressure fluid shock waves cause opening of the poppet valve and thus the opening of the fluid flow path through the outer (and inner) valve assembly.

Opening of the poppet valve also allows high pressure fluid to enter the outer (and inner valve assemblies) through the flow nut (in the embodiments where it is present). In the embodiment where there is high pressure fluid flows through ports and flow channels of an axial channel flow regulator valve, additional shocks and vibrations are generated.

These additional shock waves combine and resonate with shock waves generated by the two sliding valve assemblies and those shock waves and hammering generated during next immediate closure of the poppet valve caused by pressurized fluid into the valve assemblies, to form constructive interference resulting in shock waves of greater amplitude.

In additional embodiments, the frequency of shock waves generated by the two sliding valves can also be controlled by lengthening the valve mid-sections and/or wash pipes attached above and below each of the sliding valves, thereby affecting their travel distance, or by other adjustments to fluid pressure or adjusting the number and size of vents. All such variations are within the scope of the invention.

Other features of the invention are set forth in the drawings and detailed description which follow.

Figure 1A:
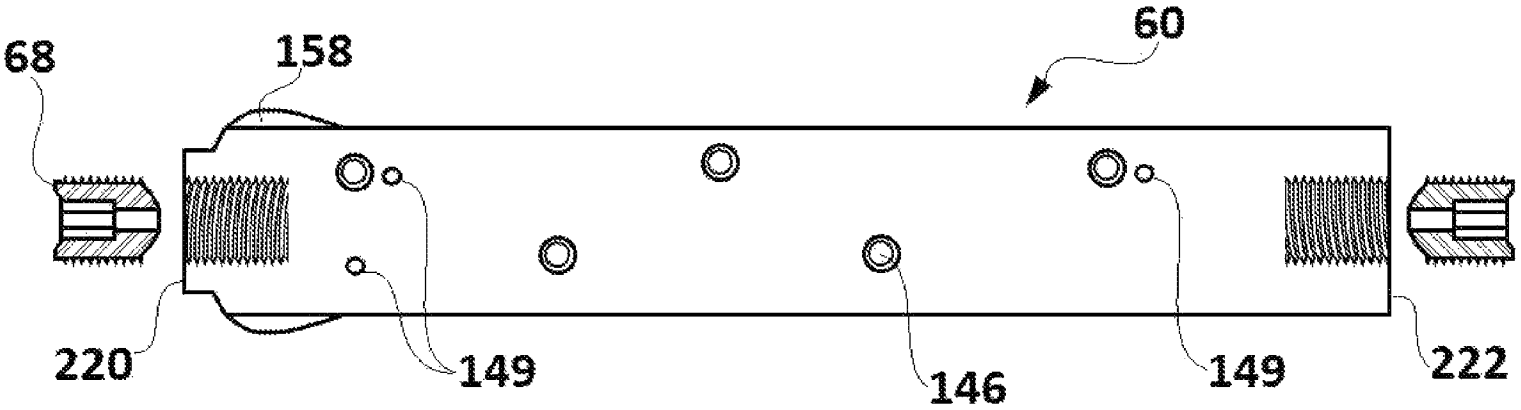
FIG. 1A is a plan view of the mating surface of one-half of a Tesla valve flow regulator, with flow regulator caps exploded.
Figure 1B:
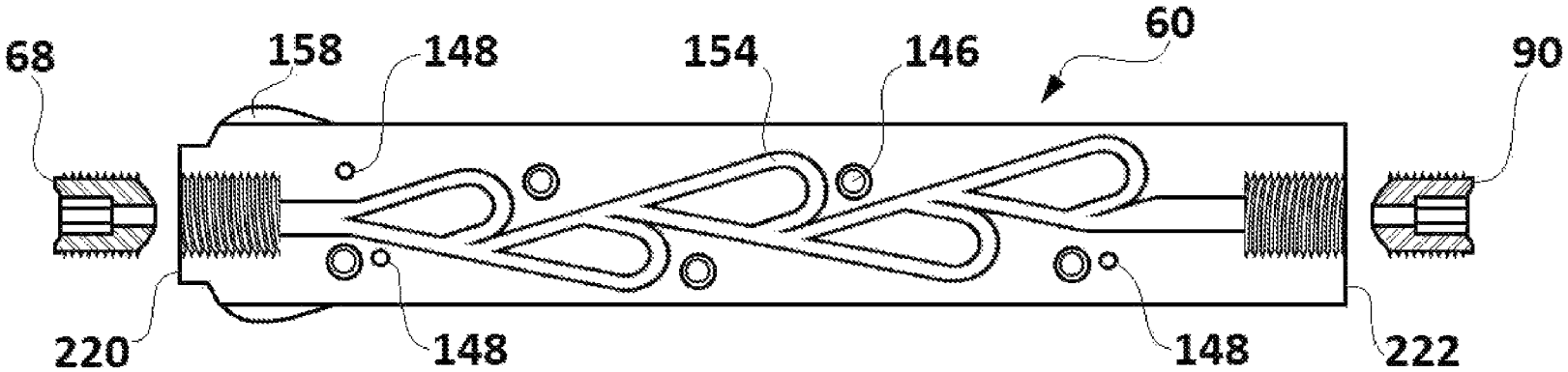
FIG. 1B is a plan view of the mating surface of the other half (from FIG. 1A) of a Tesla valve flow regulator, with flow regulator caps exploded.
Figure 2A:
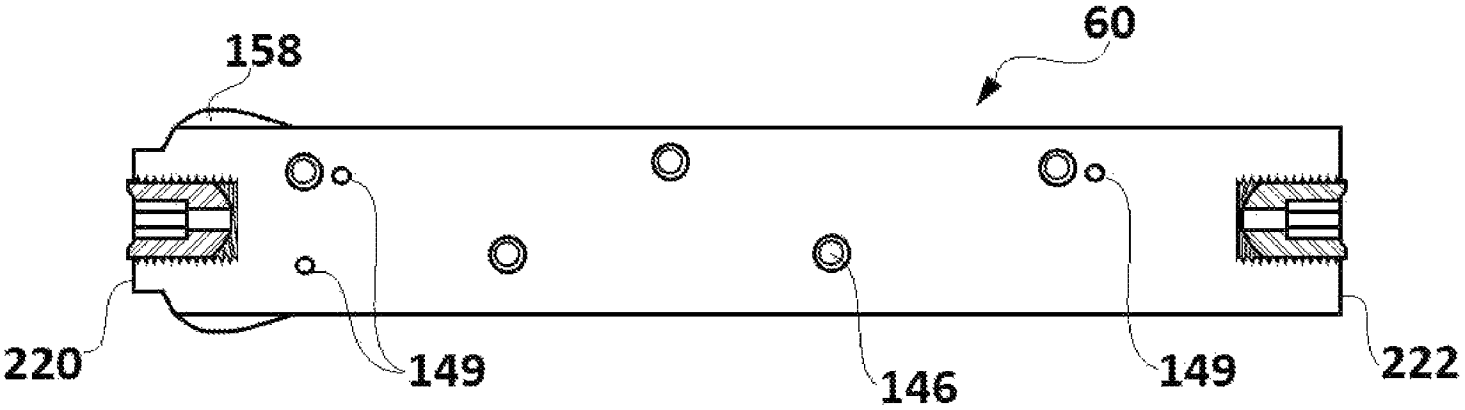
FIG. 2A is a plan view of the mating surface of one-half of a Tesla valve flow regulator shown in FIG. 1A, with flow regulator caps in place.
Figure 2B:
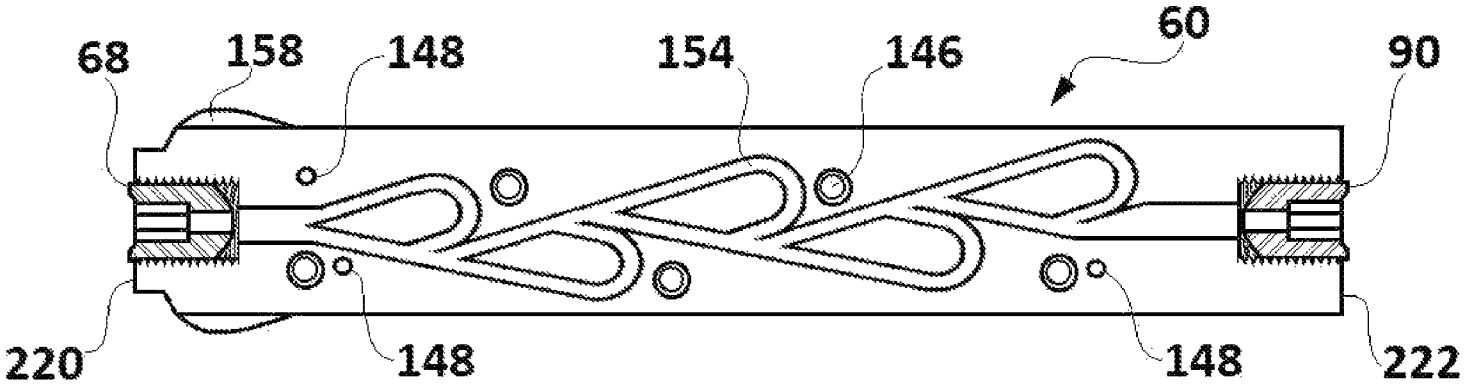
FIG. 2B is a plan view of the mating surface of one-half of a Tesla valve flow regulator shown in FIG. 1B, with flow regulator caps in place.

The figures are to be viewed in conjunction with following detailed description and may not necessarily be drawn to scale. Also, the term "upper" or "up" or "upward" denotes an upstream direction, and term "lower" or "down" or "downward" denotes a downstream direction. Still further, the term "converging" relates to convergence towards downstream direction, and the term "diverging" relates to divergence towards downstream direction.

DETAILED DESCRIPTION

A. First Embodiment with Tesla Valve Flow Regulation

Referring to FIGS. 1A to 2B, they depict views of the insides of a Tesla valve 60 composed of two "half-cylinders," which are the result of cutting a cylinder through a plane passing through the axis. A whole Tesla valve 60 is an assembled version of the two half-cylinders, joined with screws 146 and a pair of male-female pin joint (pin 148 and female hole 149) to form a complete cylindrical Tesla valve 60, with sealed flow channels 154 formed upon joining the two halves 150 and 152. Once valve 60 is assembled, the flow channels 154 form a closed, restricted fluid flow passage, which creates back pressure waves when pressurized fluid flows into valve 60 from above end 220. Screwing the flow regulator caps 68 and 90 (each having a central bore to allow passage of fluid through them) into internally threaded ends 220 and 222 of valve 60 up to a desired depth, further restricts and regulates fluid flow into and through valve 60. At the surface of upper threaded end 220, valve 60 further includes ridges 158 which are held by a holding edge 164 within lower sub 92 to fix valve 60 in place in pulsating hammering tool 10 (see FIGS. 3A to 3E).

FIGS. 3A to 3E depict various portions and valve positions of pulsating hammering tool 10. Tool includes an upper sub 11 with an open upper end 13, a lower sub 92 with an open lower end 110, and an outer barrel 21. In operation, the open-ends 13 and 110 are attached to coil tubing (not shown) or stick pipe in a drill string.

In the assembled tool 10, the upper end 7 of the outer barrel 21 screws over the threaded portion at the lower end of the upper sub 11, and the lower end 111 screws over the threaded portion at the upper end of lower sub 92. Further, within the outer barrel 21, a poppet valve 12, outer and inner valve assemblies (described below) and a vented sleeve 94 are positioned in the longitudinal space between lower end of the upper sub 11 and the upper end of the lower sub 92. The vented sleeve 94 also includes a series of inclined (or skewed) vents 96, and its lower edge abuts the upper edge of the lower sub 92. Tesla valve 60 (with flow regulator caps 68 and 90 at either end) is located within lower sub 92.

Poppet valve 12 includes two upper springs (i.e. inner spring 14 and outer spring 16) which surround a valve stem 15. Spring 14 and 16 are both compressed between the upper side of a divider 20 (included in the poppet valve 12) and washer 18 which is held by nut 120. The valve stem 15 extends through the divider 20 and is surrounded by lower spring 9 on its lower side, such that spring 9 it is compressed between the lower side of divider 20 and valve seat 22. The divider includes multiple flow channels 236 and the valve seat 22 includes multiple flow channels 238 which respectively permit fluid flow across divider 20 and valve seat 22. Valve seat 22 is preferably formed from an aluminum bronze alloy, which is more preferably 85% Cu, 10.80% Al, 3.67% Fe, Mn and 0.11% Ni.

A sleeve 166 of poppet valve 12 (lying on the upper side of divider 20) includes multiple longitudinally extended inclined (or skewed) vents 122. Vents 122 permit fluid flow into sleeve 166 whereby back pressure waves access the region on teh upper side of divider 20 and facilitate intermittent opening and closing of poppet valve 12 during operation of tool 10 (as described further below). At its upper end, sleeve 166 has a narrowed region to tightly abut and seal against a mating region at the lower edge of upper sub 11. Upper sub 11 further includes a fluid passage 254 with filter 256 held in place with a screw 252.

Figure 3A:
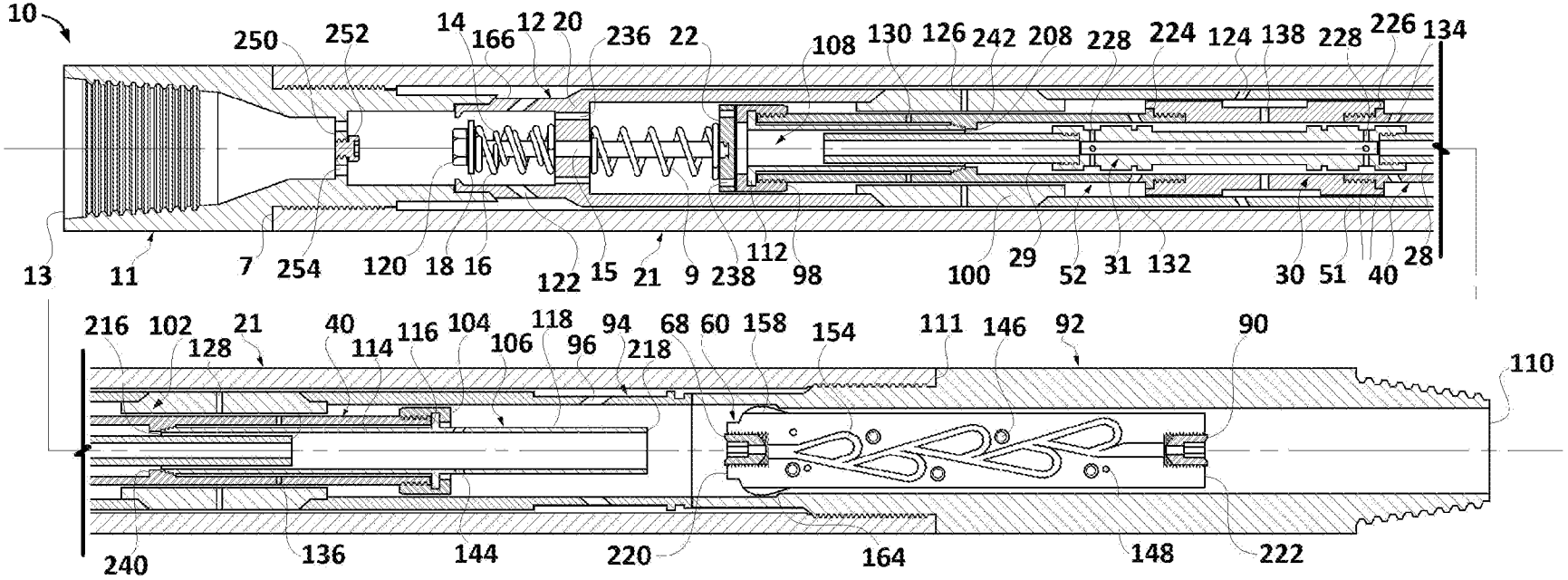
FIG. 3A is a cross sectional view of a pulsating hammering tool of the invention with the inner and outer valve assemblies in intermediate positions and the poppet valve down and sealing.

When inner spring 14 and outer spring 16 are uncompressed, the upper portions of the valve stem inner spring 14 and outer spring 16 (along with washer 18 and nut 120) extend into the lower portion of the upper sub 11, as in FIG. 3A. In operation, fluid pressure on washer 18 and nut 120 tends to compress inner spring 14 and outer spring 16 and force them below the lower end of upper sub 11.

The outer and inner valve assemblies (the inner valve assembly lying inside the outer valve assembly) are positioned within the outer barrel 21 in the longitudinal space between the lower end of poppet valve 12 and the upper end of vented sleeve 94. The outer valve assembly includes a vented upper sleeve 100, a vented lower sleeve 102, a vented middle barrel 51, an outer cylindrical valve 30, an upper outer wash pipe 52, a lower outer wash pipe 40, an upper flanged wash pipe 108, a lower flanged wash pipe 106, an upper stabilizer ring 98, and a lower stabilizer ring 104.

The outer surface of outer valve 30 has upper and lower regions of larger and equal outer diameters, the middle portion (where two opposed vents 138 lie) has a reduced outer diameter. The upper outer wash pipe 52 includes two sets of vents 130 and 132 (where there are preferably six vents 130 and two vents 132 in total), the lower outer wash pipe 40 includes two sets of vents 134 and 136 (where there are preferably two vents 134 and six vents 136 in total), and all vents, i.e. vents 130, 132, 134 and 136 facilitate fluid flow during operation of tool 10. Vents 134 and 132 are inclined (or skewed) to generate axial force component during the flow of fluid through them.

Similarly, while the vented upper sleeve 100 and the vented lower sleeve 102 each include a series of (preferably) six vents 126 and 128 respectively, the vented middle barrel 51 includes a circumferential array of inclined (or skewed) vents 124 lying in the middle of its axial length. Vents 124, 126 and 128 all facilitate fluid flow during operation of tool 10. Inclined (or skewed) vents 124 generate an axial force component from the flow of fluid through them.

While the lower end of vented upper sleeve 100 mates with the upper end of vented middle barrel 51, the upper end of vented upper sleeve 100 mates with the lower end of poppet valve 12. Similarly, while the upper end of vented lower sleeve 102 mates with the lower end of vented middle barrel 51, the lower end of vented lower sleeve 102 mates with the upper end of vented sleeve 94. The assembly of the vented upper sleeve 100, vented middle barrel 51 and the vented lower sleeve 102 is fixed within the space between the lower end of poppet valve 12 and the upper end of vented sleeve 94.

The inner diameter of the vented middle barrel 51 is larger than the inner diameters of the vented upper sleeve 100 and the vented lower sleeve 102. Outer valve 30 lies within the vented middle barrel 51 and slides within the space between the lower end of vented upper sleeve 100 and the upper end of vented lower sleeve 102. The upper end of outer valve 30 is screwed over the threaded lower end of upper outer wash pipe 52 (such that lower flange 224 of upper outer wash pipe 52 abuts upper end of outer valve 30). Similarly, lower end 200 of outer valve 30 is screwed over the threaded upper end 176 (illustrated in FIG. 3A) of lower outer wash pipe 40 (such that lower flange 226 of lower outer wash pipe 40 abuts lower end 200 of the outer valve 30).

The threaded lower end of upper flanged wash pipe 108 screws into internal threads on the upper side of ledge 242 in upper outer wash pipe 52 in a manner such that such that its flange 112 abuts the threaded upper end of upper outer wash pipe 52. The upper stabilizer ring 98 screws over the threaded upper end of the upper outer wash pipe 52 to hold upper flanged wash pipe 108 in place. Similarly, longer arm 114 of the lower flanged wash pipe 106 threads into internal threads on the lower side of the ledge 240 within lower outer wash pipe 40. The lower stabilizer ring 104 screws over the threaded lower end of lower outer wash pipe 40. Once in position, the vented arm 118 of lower flanged wash pipe 106 extends downstream beyond the lower stabilizer ring 104. The vented arm 118 further includes a pair of inclined (or skewed) vents 144 (lying diametrically opposed on the surface of the vented arm 118), which facilitate fluid flow during operation of tool 10.

The inner valve assembly includes an inner valve 31, an upper inner wash pipe 29, and a lower inner wash pipe 28. The upper end of inner valve 31 screws over threaded lower end of the upper inner wash pipe 29, the lower end of inner valve 31 screws over threaded upper end of lower inner wash pipe 28. The inner valve assembly is positioned inside the outer valve assembly (more particularly within the outer valve 30, the upper outer wash pipe 52, and the lower outer wash pipe 40), and is slidable within the outer valve assembly downwardly to where the lower edge of inner valve 31 contacts the upper edge of ledge 240 in lower outer wash pipe 40. The inner valve assembly is slidable upwardly to where the upper edge of inner valve 31 contacts the lower edge of ledge 242 in upper outer wash pipe 52.

Inner valve 31 includes an array of flow channels through vents 228 near each of its ends. Though in the current embodiment the vents 228 are illustrated to be transverse to the axis of inner valve 31, based on requirements, in other embodiments of the invention vents 228 may be inclined (or skewed) to the axis of inner valve 31.

In assembled tool 10, the upper and lower threaded ends of outer barrel 21 mate, respectively, with upper sub 11 and lower sub 92 to form a sealed chamber formed by its inner surface wherein the inner diameter of this chamber is larger than the outer diameters of any of the components within it—and fluid can flow between the outer surface of the components and the inner surface of outer barrel 21. Similarly, in the assembled tool 10, the dimensions of all components of outer and inner valve assemblies are kept such that both the outer and inner valve assemblies are slidable longitudinally within their designated longitudinal limits as described above.

During the operation, increased fluid pressure in tool 10 may cause temporary reduction in axial length and an increase in the outer diameters of the outer valve 30 and/or the inner valve 31. Such expansion of outer valve 30 may cause the outer surfaces of the upper portion 234 and lower portion 230 to touch the internal surface of vented middle barrel 51, and inhibit sliding of the outer cylindrical valve 30 within the vented middle barrel 51. Similarly, expansion of inner valve 31 may cause it to contact the inner surfaces of the outer valve assembly. Outer valve 30 and inner valve 31 are preferably formed from an aluminum bronze alloy, which is more preferably 85% Cu, 10.80% Al, 3.67% Fe, 0.42% Mn and 0.11% Ni.

Figure 3B:
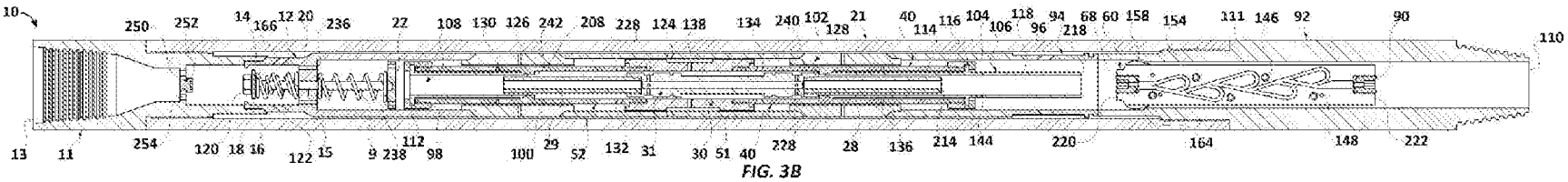
FIG. 3B is a cross sectional view of the tool with the outer valve assembly in an intermediate position, the inner valve assembly fully down, and the poppet valve slightly raised.

In operation, tool 10 is connected to a fluid pressure source, not shown. FIG. 3B illustrates an intermediate state of tool 10; with springs 14, 16 and 9 being in an uncompressed state. In the rest state, both the outer and inner valve assemblies may lie anywhere within their designated travel range.

In an operating tool 10, it is to be noted that among multiple flow passages, only those through which flow of fluid has significant impact on operation of the tool 10 are described herein below. Other flow paths, through which flow of fluid has a limited impact on operation of tool 10 are not discussed.

Pressurized fluid flows into the tool 10 from the upper sub 11 (through the open end 13 attached to a drill string or tubing, not illustrated) and gets delivered into the poppet valve 12. Fluid flows through flow channels 236 and vents 122, and also through channels 238 when they are open, as illustrated e.g., in FIGS. 3B; 3D. From channels 238, there is a flow path through the inner and outer valve assemblies and to lower sub 92. Similarly, there is a restricted fluid flow path through vents 122 and downstream through the restricted space between the inner surface of outer barrel 21 and outer surfaces of poppet valve 12, vented upper sleeve 100, vented lower sleeve 102, vented middle barrel 51 and vented sleeve 94. The path continues through vents 96, into the inner chamber of vented sleeve 94, and to lower sub 92.

Figure 3C:
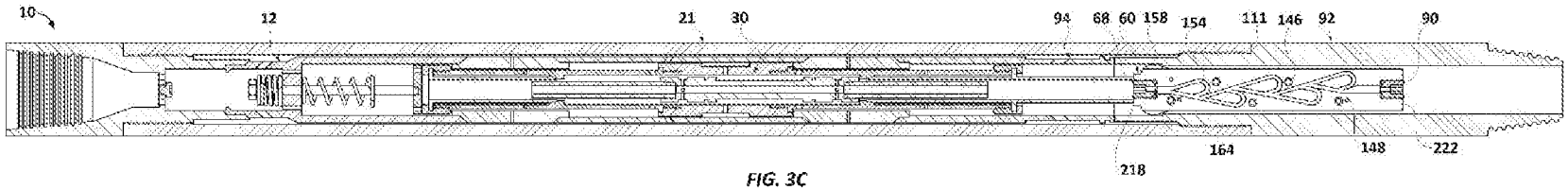
FIG. 3C is a cross sectional view of the tool with the inner and outer valve assemblies in the maximally downward position and the poppet valve down and sealing.
Figure 3D:
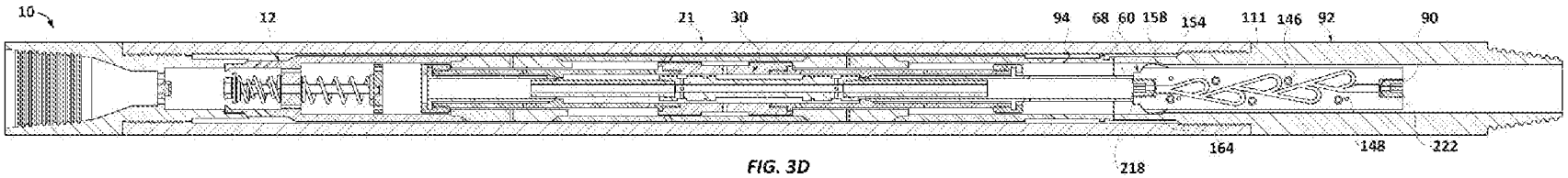
FIG. 3D is a cross sectional view of the tool with the inner and outer valve assemblies in the maximally downward position and the poppet valve slightly raised and not sealing.
Figure 3E:
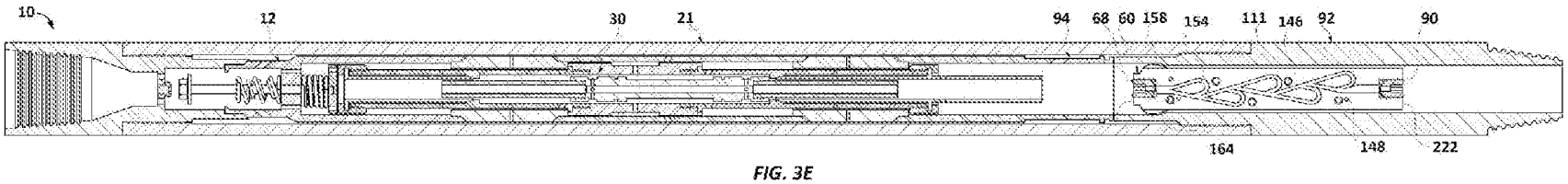
FIG. 3E is a cross sectional view of the tool with the inner and outer valve assemblies in the maximally upward position with the poppet valve sealing.

As shown in FIG. 3C, inflow of pressurized fluid into the upper sub 11 pushes washer 18 and valve seat 22 downstream to where springs 14 and 16 are maximally compressed and valve stem 15 presses valve seat 22 against the upper stabilizer ring 98, thereby blocking flow channel 238 and hence the fluid flow path through both the inner and outer valve assemblies. The outer valve assembly is pushed down by pressurized fluid to where outer cylindrical valve 30 contacts the upper end of lower sleeve 102 (as illustrated in FIG. 3C; 3D) whereby lower end 218 of lower flanged wash pipe 106 covers the upper end of valve 60 and flow regulator 68. Blockage of the fluid flow path through the inner and outer valve assemblies by valve seat 22 generates a reverse shock wave in the fluid. The contact of valve 60 with lower flanged wash pipe 106 forces all fluid flowing through the inner and outer valve assemblies into the restricted flow path within valve 60, which generates another significant back pressure wave.

Further back pressure waves are generated upon movement of the inner and outer valve assemblies. In certain positions of the of the inner and outer valve assemblies, there can be an open fluid flow path from the inner valve assembly, through vents 228, then through vents 130, 132 and 138, and then through vents 124, 126 and 128 and into the restricted space just inside outer barrel 21. Movement of the inner and outer valve assemblies opens and closes some of the vents, generating back pressure waves upon certain closings.

All back pressure waves can follow any of the open flow paths upwards, and then enter vents 122 in poppet valve 12. As each back pressure wave is also immediately adjacent to a following low pressure wave, the low pressure waves entering the upper part of the poppet valve 12 through vents 122 is sufficient such that springs 14, 16 force valve stem 15 upwardly and momentarily open valve seat 22 (see FIGS. 3B; 3D) before fluid pressure from above closes poppet valve 12 again. Back pressure waves generated in the lower portions of tool 10 will also induce intermittent upward movement of the inner and outer valve assemblies; unless they are positioned at the respective limit of their upward travel.

The frequency of upstrokes and downstrokes of the inner and outer valve assemblies, which also affects the frequency of opening and closing of poppet valve 12, is affected by adjusting the length of inner wash pipes 28, 29 and inner valve 31, and/or outer wash pipes 40, 52 and outer valve 30. The oscillation frequency of poppet valve 12 can also be changed by selecting springs 9, 14, 16 with different compression strengths, or by changing the pressure of the fluid supplied to tool 10.

Figure 4:
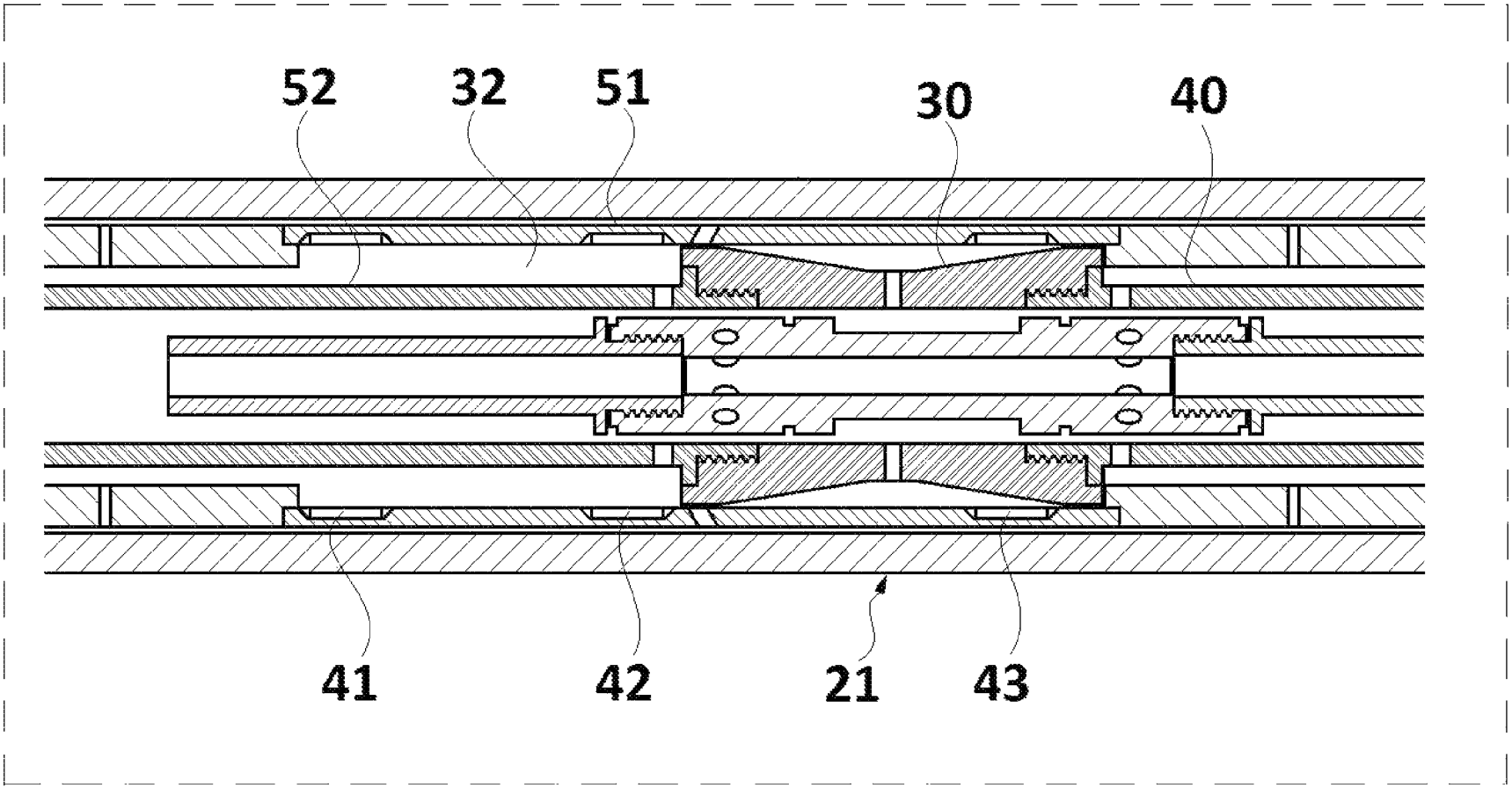
FIG. 4 is a cross sectional view of a different embodiment of a portion of a barrel surrounding outer valve 30.

FIG. 4 is a different embodiment of vented middle barrel 51 which accommodates outer cylindrical valve 30 inside has three areas 41, 42 and 43 of slightly expanded inner diameter along their length (between 1/1000 to 1/1,000,000 of an inch, and preferably about 1/100,000 of an inch). During operation, outer cylindrical valve 30 (having an outer diameter which expands slightly due to the fluid pressure acting on its upper and lower ends) moves rapidly through the expanded areas 41, 42 and 43, and slows considerably elsewhere during travel due to binding in non-expanded regions. The oscillation frequency of the outer valve assembly in this embodiment and in the first embodiment can also be controlled by adjusting the internal diameter of vented middle barrel 51 or the external diameter of outer cylindrical valve 30.

Figure 5:
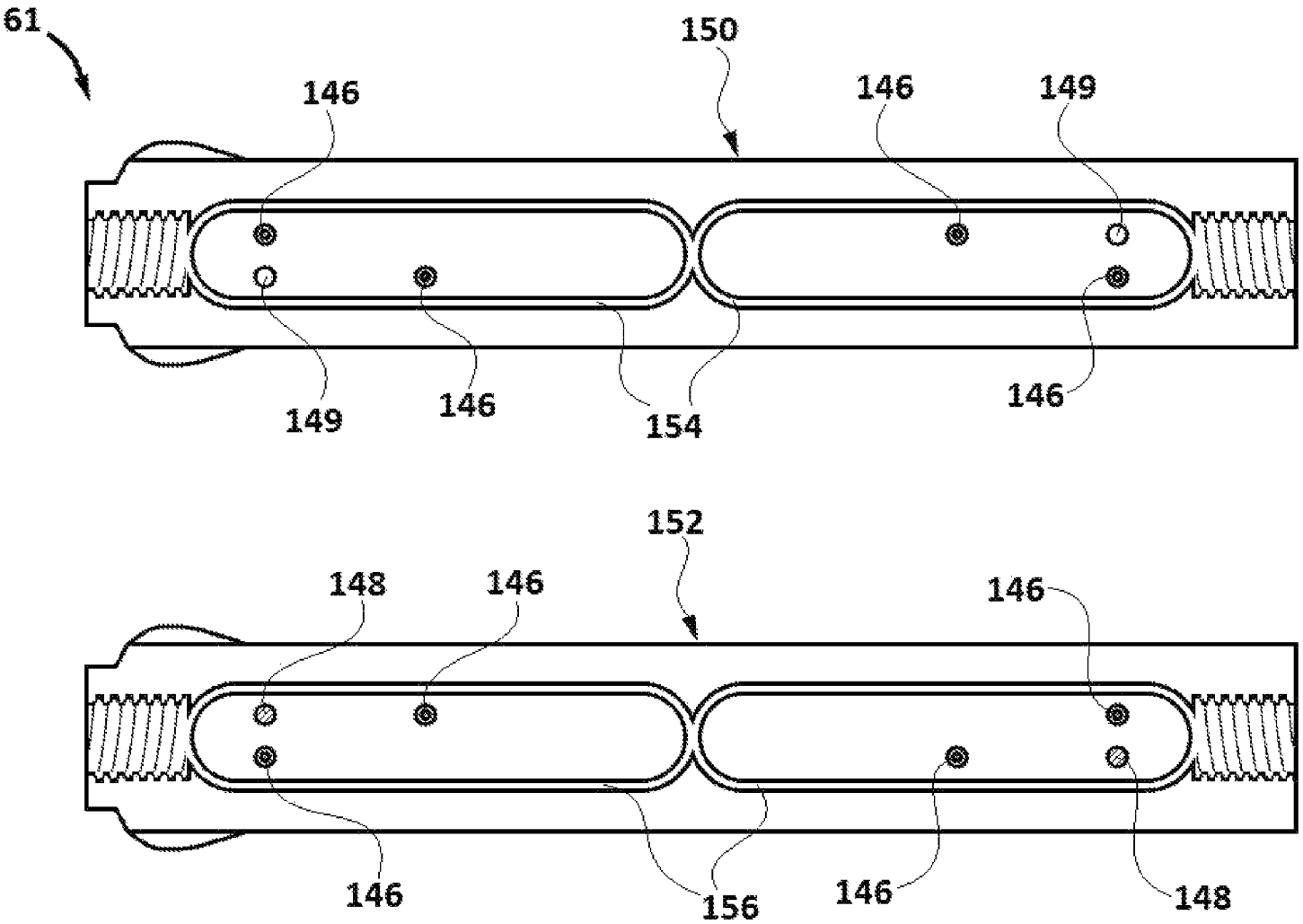
FIG. 5 is a is a plan view of the mating surfaces of both halves of a different embodiment of a flow regulator valve.

FIG. 5 is an embodiment of a back pressure valve 61 which can be substituted in tool 10 for Tesla valve 60. Valve 61 is also composed of two "half-cylinders," which are the result of cutting a cylinder through a plane passing through the axis. A whole valve 61 is an assembled version of the two half-cylinders, joined with screws 146 and a pair of male-female pin joint (pin 148 and female hole 149) to form a complete cylindrical valve 61, with sealed flow channels 156 formed upon joining the two halves 150 and 152. As for valve 60, flow regulator caps 68 and 90 are preferably respectively screwed into the internally threaded regions at either end of valve 61.

Figure 6:
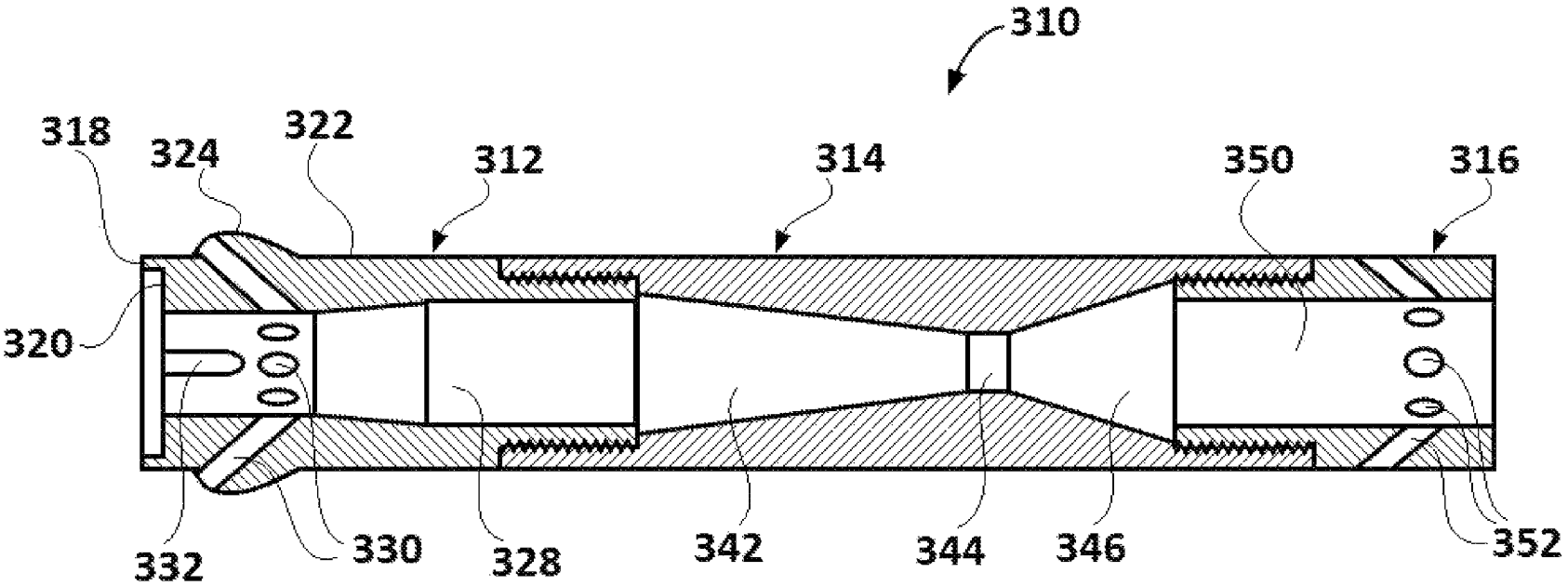
FIG. 6 illustrates a longitudinal cross-section of an embodiment of an assembled axial channel flow regulator valve.

B. Second Embodiment with Assembled Axial Channel Flow Regulator Valve; Including Embodiment with Extended Button in Outer Valve Assembly FIG. 6 illustrates a longitudinal cross-section of an embodiment of an assembled axial channel flow regulator valve 310 composed of three components: an upper mini-sub 312, a central mini cylinder 314 and a lower mini-sub 316. Individual longitudinal cross-sections of each of the upper mini-sub 312, a central mini cylinder 314 and a lower mini-sub 316 are illustrated in FIGS. 7A, 8 and 9A respectively.

Figure 7B:
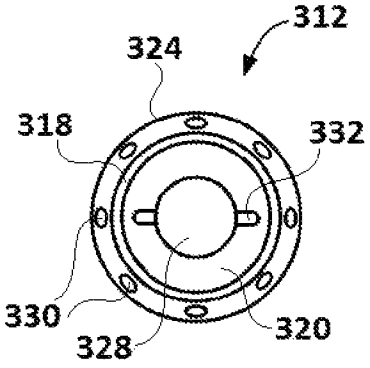
FIG. 7B illustrates a side view of the upper mini-sub as seen from its upper end.

FIG. 7B illustrates a side view of the upper mini-sub 312 as seen from its upper end. FIG. 7C is similar to FIG. 7A, except that the cross-sections shown in FIG. 7C is taken along a plane including the longitudinal axis of the upper mini-sub 312 and which is transverse to the cross-sectional plane shown in FIG. 7A.

Figure 7A:
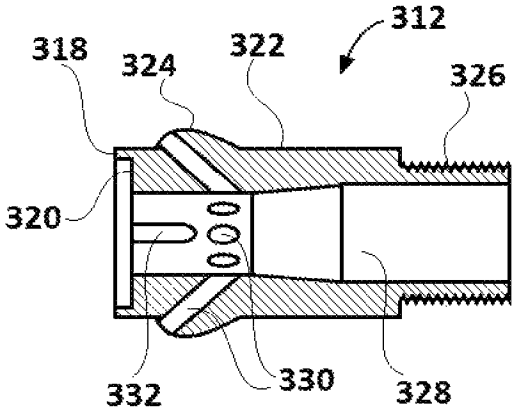
FIG. 7A illustrates a longitudinal cross-section of upper mini-sub of the assembled axial channel flow regulator valve illustrated in FIG. 6.
Figure 7C:
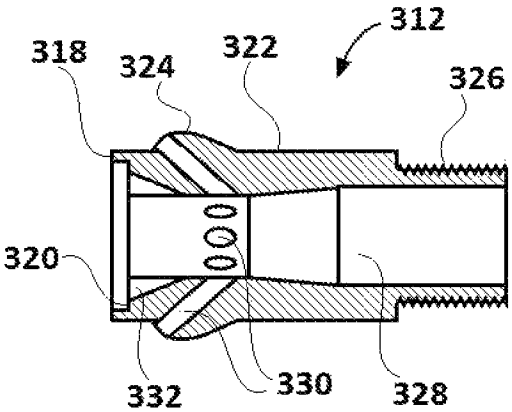
FIG. 7C illustrates a longitudinal cross-section of the upper mini-sub of FIG. 6 taken along a plane including the longitudinal axis of the upper mini-sub and which is perpendicular to the cross-sectional plane of FIG. 7A.

As shown in FIGS. 6, and 7A-7C, the upper mini-sub 312 includes an upper end 318, strike seat 320, a cylindrical portion 322, an annular bulge 324, an externally threaded lower end 326, an internal flow channel 328, plurality of converging flow channels 330 and two channel extension arms 332. The annular bulge 324 lies proximal to the upper end 318 and surrounds the cylindrical portion 322. As shown in the figures, flow channels 330 are spread symmetrically around internal flow channel 328, and each flow channel 330 runs through the bulge 24 to interconnect the exterior of the upper mini-sub 312 with the internal flow channel 328. The channel extension arms 332 are extensions of flow channel 328 interconnecting it to the strike seat 320. The channel extension arms 332 are positioned opposite to each other on the periphery of flow channel 328. FIGS. 7A and 7C clearly illustrate the orientation of channel extension arms 332. In this embodiment, internal flow channel 328, preferably, is forced into a narrower upper end 318 and then a broader lower end 326, though the relative size of different sections of flow channel 328 can vary.

Figure 8:
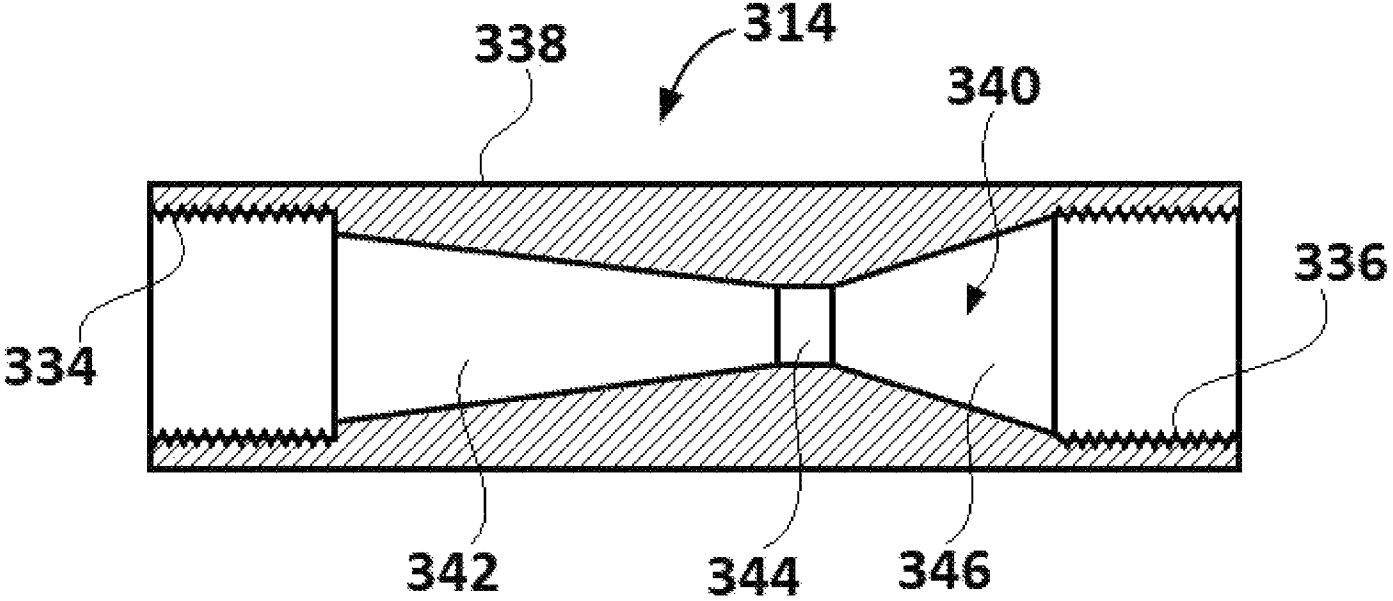
FIG. 8 illustrates a longitudinal cross-section of the central mini cylinder of the assembled axial channel flow regulator valve illustrated in FIG. 6.

The central mini cylinder 314, as shown in FIGS. 6 and 8 includes an upper internally threaded end 334, a lower internally threaded end 336, a central cylindrical portion 338, and a three stage flow channel 340 lying between ends 334 and 336. The three stage flow channel 340 further includes a converging flow channel 342, a constant channel 344 and a diverging flow channel 346. In various embodiments of the central mini cylinder 314, the dimensions, geometrical shape and orientations of the converging flow channel 342, the constant channel 344 and the diverging flow channel 346 may be altered to suit a desired back pressure or other considerations.

Figure 9B:
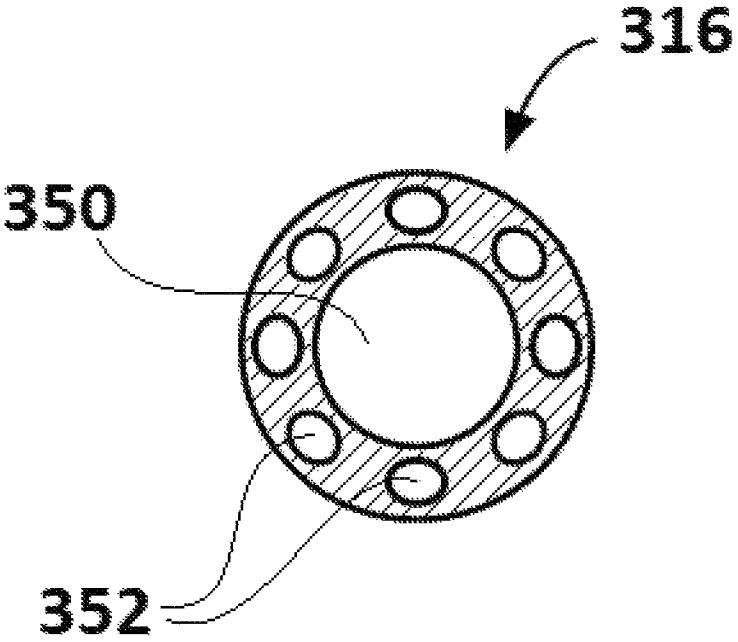
FIG. 9B illustrates a transverse cross-section of lower mini-sub 16 taken along a plane perpendicular to its longitudinal axis (illustrated by line AA' in FIG. 9A).
Figure 9A:
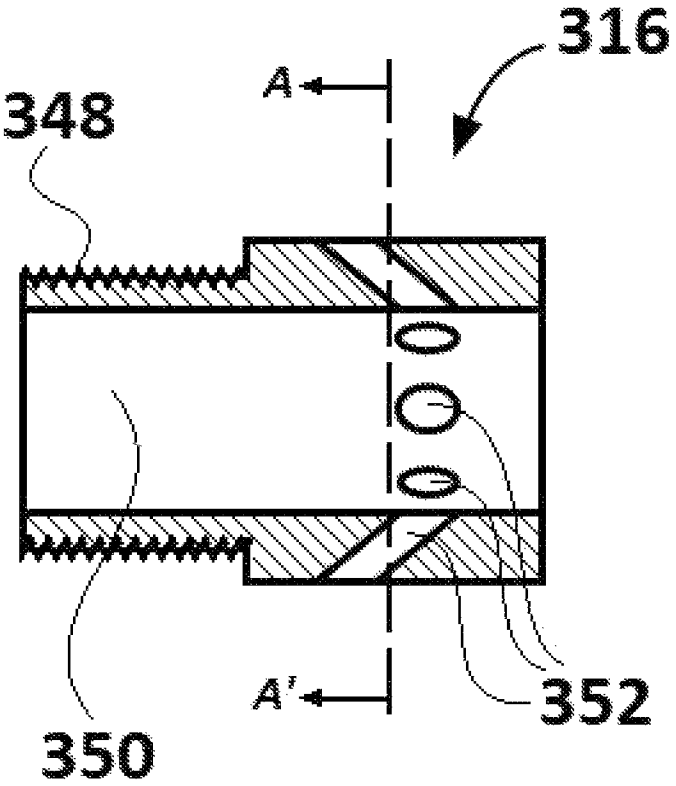
FIG. 9A illustrates longitudinal cross-section of lower mini-sub of the assembled axial channel flow regulator valve illustrated in FIG. 6.

FIG. 9B illustrates a transverse cross-section of lower mini-sub 316 taken along a plane transverse to its longitudinal axis (illustrated by line AA' in FIG. 9A). As shown in FIGS. 6, 9A and 9B, the lower mini-sub 316 includes an upper externally threaded end 348, a central flow channel 350 and plurality of diverging flow channels 352 connecting central flow channel 350 with the exterior of lower mini-sub 316.

It is to be noted that in various other embodiments of the assembled axial channel flow regulator valve 310, the convergence of converging flow channels 330 and converging flow channel 342, the divergence of diverging flow channels 352 and diverging flow channel 346 may be altered to suit a desired back pressure or other considerations.

Figure 10:
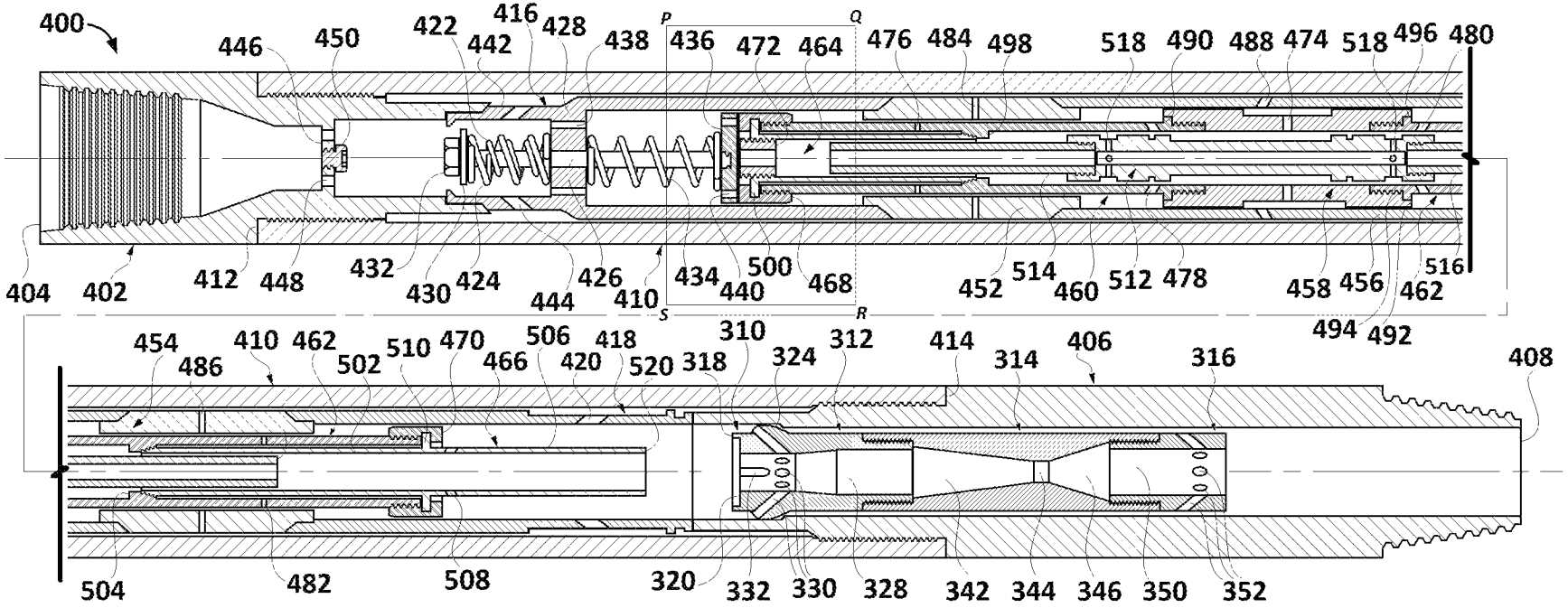
FIG. 10 illustrates a longitudinal cross-section of an embodiment of the pulsating hammer tool with the assembled axial channel flow regulator valve of FIG. 6 installed.

FIG. 10 illustrates a first embodiment of the pulsating hammering tool 400 having the assembled axial channel flow regulator valve 310, as described above, installed. Tool 400 includes an upper sub 402 with an open upper end 404, a lower sub 406 with an open lower end 408, and an outer barrel 410. In operation, the open-ends 404 and 408 are attached to coil tubing (not shown) or stick pipe in a drill string.

In the assembled tool 400, the upper end 412 of the outer barrel 410 screws over the threaded portion at the lower end of the upper sub 402, and the lower end 414 screws over the threaded portion at the upper end of lower sub 406. Further, within the outer barrel 410, a poppet valve 416, outer and inner valve assemblies (described below) and a vented sleeve 418 are positioned in the longitudinal space between lower end of the upper sub 402 and the upper end of the lower sub 406. The vented sleeve 418 also includes a series of inclined (or skewed) vents 420, and its lower edge abuts the upper edge of the lower sub 406. The assembled axial channel flow regulator valve 310 is located within lower sub 406.

Poppet valve 416 includes two upper springs (i.e. inner spring 422 and outer spring 424) which surround a valve stem 426. Spring 422 and 424 are both compressed between the upper side of a divider 428 (included in the Poppet valve 416) and washer 430 which is held by nut 432. The valve stem 426 extends through the divider 428 and is surrounded by lower spring 434 on its lower side, such that spring 434 it is compressed between the lower side of divider 428 and valve seat 436. The divider 428 includes multiple flow channels 438 and the valve seat 436 includes multiple flow channels 440 which respectively permit fluid flow across divider 428 and valve seat 436. Valve seat 436 is preferably formed from an aluminum bronze alloy, which is more preferably 85% Cu, 10.80% Al, 3.67% Fe, 0.42% Mn and 0.11% Ni.

A sleeve 442 of Poppet valve 416 (lying on the upper side of divider 428) includes multiple longitudinally extended inclined (or skewed) vents 444. Vents 444 permit fluid flow into sleeve 442 whereby back pressure waves access the region on the upper side of divider 428 and facilitate intermittent opening and closing of Poppet valve 416 during operation of tool 400 (as described further below). At its upper end, sleeve 442 has a narrowed region to tightly abut and seal against a mating region at the lower edge of Upper sub 402. Upper sub 402 further includes a filter 446 having multiple fluid passages 448 and a central plug screw 450. Removal of the central plug screw 450 facilitates an additional fluid passage.

When inner spring 422 and outer spring 424 are uncompressed, the upper portions of the valve stem 426, inner spring 422 and outer spring 424 (along with washer 430 and nut 432) extend into the lower portion of the upper sub 402, as in FIG. 8A. In operation, fluid pressure on washer 430 and nut 432 tends to compress inner spring 422 and outer spring 424 and force them below the lower end of upper sub 402.

Figure 11:
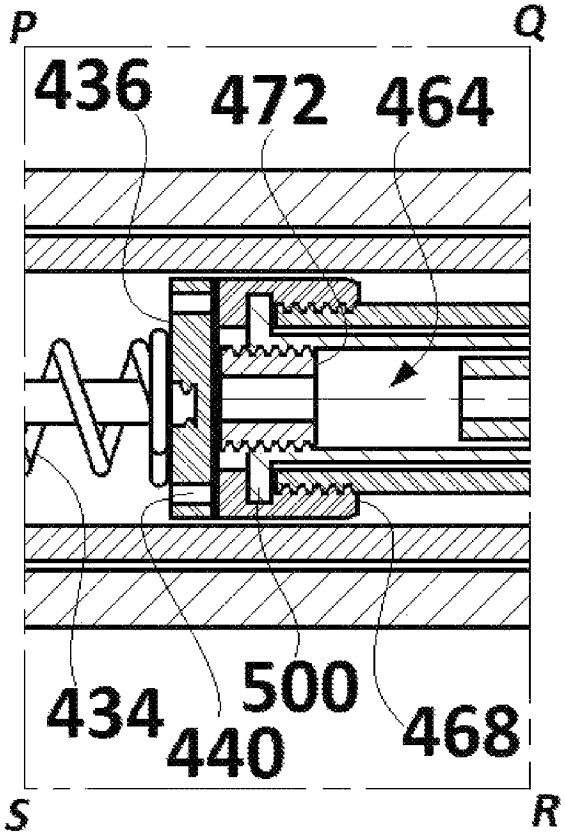
FIG. 11 illustrates a magnified view of a portion PQRS of a cross-section of FIG. 10.

The outer and inner valve assemblies (the inner valve assembly lying inside the outer valve assembly) are positioned within the outer barrel 410 in the longitudinal space between the lower end of Poppet valve 416 and the upper end of vented sleeve 418. The outer valve assembly includes a vented upper sleeve 452, a vented lower sleeve 454, a vented middle barrel 456, an outer cylindrical valve 458, an upper outer wash pipe 460, a lower outer wash pipe 462, an upper flanged wash pipe 464, a lower flanged wash pipe 466, an upper stabilizer ring 468, and a lower stabilizer ring 470. An externally threaded flow nut 472 is screwed into the upper end of the flanged wash pipe 464 to enhance fluid pressure flowing through the outer (and inner) valve assemblies. A magnified view of a portion PQRS (shown on FIG. 10, and which includes illustration of flow nut 472 in place) is provided in FIG. 11. During the downstrokes of tool 100, the lower end 520 of the lower flanged wash pipe 466 strikes seat 320 of the assembled axial channel flow regulator valve 310 to generate hammering.

The outer surface of outer valve 458 has upper and lower regions of larger and equal outer diameters, the middle portion (where two opposed vents 474 lie) has a reduced outer diameter. The upper outer wash pipe 460 includes two sets of vents 476 and 478 (where there are preferably six vents 476 and two vents 478 in total), the lower outer wash pipe 462 includes two sets of vents 480 and 482 (where there are preferably two vents 480 and six vents 482 in total), and all vents, i.e. vents 476, 478, 480 and 482 facilitate fluid flow during operation of tool 400. Vents 480 and 478 are inclined (or skewed) to generate an axial force component of the flow of fluid through them.

Similarly, while the vented upper sleeve 452 and the vented lower sleeve 454 each include a series of (preferably) six vents 484 and 486 respectively, the vented middle barrel 456 includes a circumferential array of inclined (or skewed) vents 488 lying in the middle of its axial length. Vents 488, 484 and 486 all facilitate fluid flow during operation of tool 400. Inclined (or skewed) vents 488 generate an axial force component of the flow of fluid through them.

While the lower end of vented upper sleeve 452 mates with the upper end of vented middle barrel 456, the upper end of vented upper sleeve 452 mates with the lower end of Poppet valve 416. Similarly, while the upper end of vented lower sleeve 454 mates with the lower end of vented middle barrel 456, the lower end of vented lower sleeve 454 mates with the upper end of vented sleeve 418. The assembly of the vented upper sleeve 452, vented middle barrel 456 and the vented lower sleeve 454 is fixed within the space between the lower end of Poppet valve 416 and the upper end of vented sleeve 418.

The inner diameter of the vented middle barrel 456 is larger than the inner diameters of the vented upper sleeve 452 and the vented lower sleeve 454. Outer valve 458 lies within the vented middle barrel 456 and slides within the space between the lower end of vented upper sleeve 452 and the upper end of vented lower sleeve 454. The upper end of outer valve 458 is screwed over the threaded lower end of upper outer wash pipe 460 (such that upper flange 490 of upper outer wash pipe 460 abuts upper end of outer valve 458). Similarly, lower end 492 of outer valve 458 is screwed over the threaded upper end 494 of lower outer wash pipe 462 (such that lower flange 496 of lower outer wash pipe 462 abuts lower end 492 of the outer valve 458).

The threaded lower end of upper flanged wash pipe 464 screws into internal threads on the upper side of ledge 498 in upper outer wash pipe 460 in a manner such that such that its flange 500 abuts the threaded upper end of upper outer wash pipe 460. The upper stabilizer ring 468 screws over the threaded upper end of the upper outer wash pipe 460 to hold upper flanged wash pipe 464 in place and surround the externally threaded flow nut 472 (which is screwed into the upper end of the flanged wash pipe 464). Similarly, longer arm 502 of the lower flanged wash pipe 466 threads into internal threads on the lower side of the ledge 504 within lower outer wash pipe 462. The lower stabilizer ring 470 screws over the threaded lower end of lower outer wash pipe 462. Once in position, the vented arm 506 of lower flanged wash pipe 466 extends downstream beyond the lower stabilizer ring 470 (flange 510 of pipe 466 abutting lower end of lower outer wash pipe 462). The vented arm 506 further includes a pair of inclined (or skewed) vents 508 (lying diametrically opposed on the surface of the vented arm 506), which facilitate fluid flow during operation of tool 400.

The inner valve assembly the includes an inner valve 512, an upper inner wash pipe 514, and a lower inner wash pipe 516. The upper end of inner valve 512 screws over threaded lower end of the upper inner wash pipe 514, the lower end of inner valve 512 screws over threaded upper end of lower inner wash pipe 516. The inner valve assembly is positioned inside the outer valve assembly (more particularly within the outer valve 458, the upper outer wash pipe 460, and the lower outer wash pipe 462), and is slidable within the outer valve assembly downwardly to where the lower edge of inner valve 512 contacts the upper edge of ledge 504 in lower outer wash pipe 462. The inner valve assembly is slidable upwardly to where the upper edge of inner valve 512 contacts the lower edge of ledge 498 in upper outer wash pipe 460.

Inner valve 512 includes an array of flow channels through vents 518 near each of its ends. Though in the current embodiment the vents 518 are illustrated to be transverse to the axis of inner valve 512, based on requirements, in other embodiments of the invention vents 518 may be inclined (or skewed) to the axis of inner valve 512.

In assembled tool 400, the upper and lower threaded ends of outer barrel 410 mate, respectively, with Upper sub 402 and lower sub 406 to form a sealed chamber formed by its inner surface wherein the inner diameter of this chamber is larger than the outer diameters of any of the components within it—and fluid can flow between the outer surface of the components and the inner surface of outer barrel 410. Similarly, in the assembled tool 400, the dimensions of all components of outer and inner valve assemblies are kept such that both the outer and inner valve assemblies are slidable longitudinally within their designated longitudinal limits as described above.

The embodiment of the device in FIGS. 1 to 5, can be mixed with components described above and shown in FIGS. 6 to 9B, and different combinations. Similarly, the embodiments described above and shown in FIGS. 6 to 9B can be mixed with components from the device in FIGS. 1 to 5.

Figure 12:
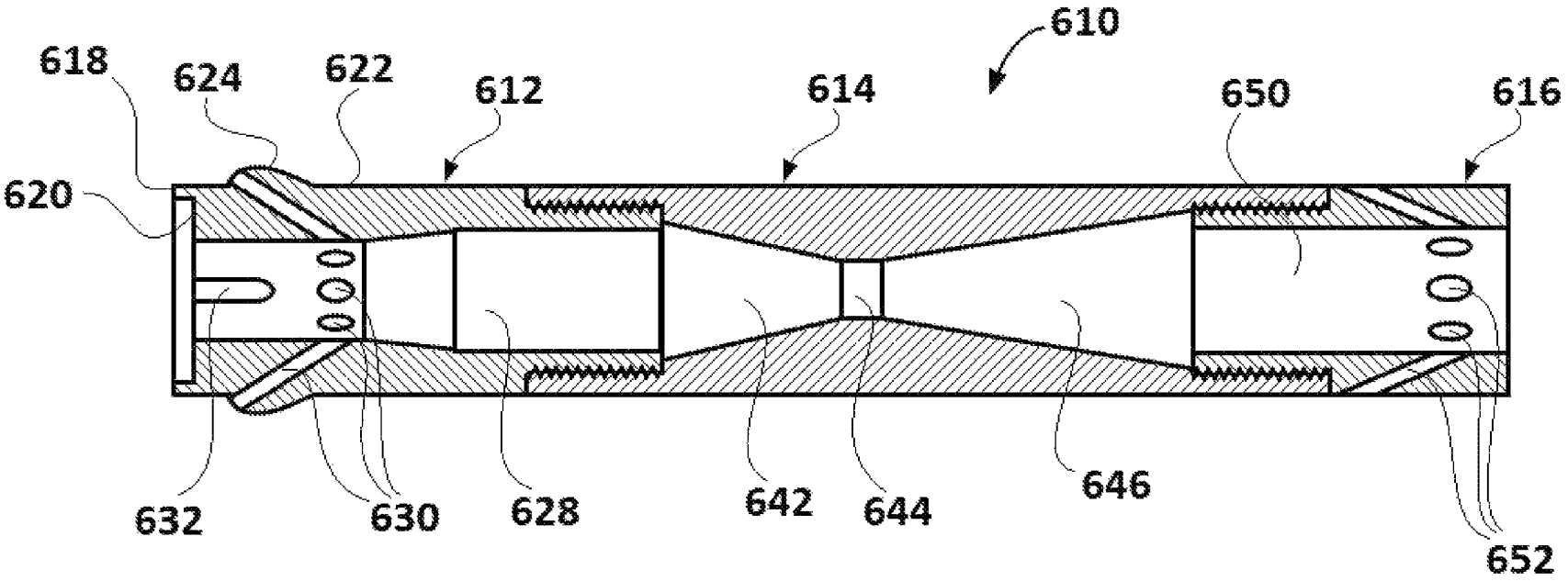
FIGS. 12 and 13 each illustrates additional embodiments the assembled axial channel flow regulator valve in accordance with the present invention.

FIG. 12 illustrates a longitudinal cross-section of another embodiment of the assembled axial channel flow regulator valve of FIG. 6. As shown in FIG. 12, the assembled axial channel flow regulator valve 610 composed of three components: an upper mini-sub 612, a central mini cylinder 614 and a lower mini-sub 616.

As shown in FIG. 12, The upper mini-sub 612 includes an upper end 618, strike seat 620, a cylindrical portion 622, an annular bulge 624, an internal flow channel 628, plurality of converging flow channels 630 and two channel extension arms 632 (only one being visible in FIG. 12). The channel extension arms 632 are similar to the arms 332 shown in FIGS. 6 and 7A-7C. The channel extension arms 632 are positioned opposite to each other on the periphery of flow channel 628. Orientation of channel extension arms 632 are similar to those of arms 332 illustrated in FIGS. 7A-7C. The channel extension arms 632 are extensions of flow channel 628 interconnecting it to strike seat 620. The annular bulge 624 lies proximal to the upper end 618 and surrounds the cylindrical portion 622. As shown, the flow channels 630 are spread symmetrically around internal flow channel 628, and each flow channel 630 runs through the bulge 624 to interconnect the exterior of the upper mini-sub 612 with the internal flow channel 628. Structurally, the internal flow channel 628 is similar to the arms internal flow channel 328 shown in FIGS. 6 and 7A-7C.

The central mini cylinder 614 includes an upper internally threaded end 634, a lower internally threaded end 636, a central cylindrical portion 638, a converging flow channel 642, a constant channel 644 and a diverging flow channel 646. As compared to corresponding portions of assembled axial channel flow regulator valve 310 of FIG. 6, the converging flow channel 642 is of a shorter axial length, and the diverging flow channel 646 is of a longer axial length. Similarly, in comparison to flow channels 330 and 352 of assembled axial channel flow regulator valve 310, corresponding the flow channels 630 and 652 are narrower and lean more towards the longitudinal axis of the assembled axial channel flow regulator valve 610. The structure of constant channel 644 is same as that of the constant channel 344 of axial channel flow regulator valve 310.

Figure 13:
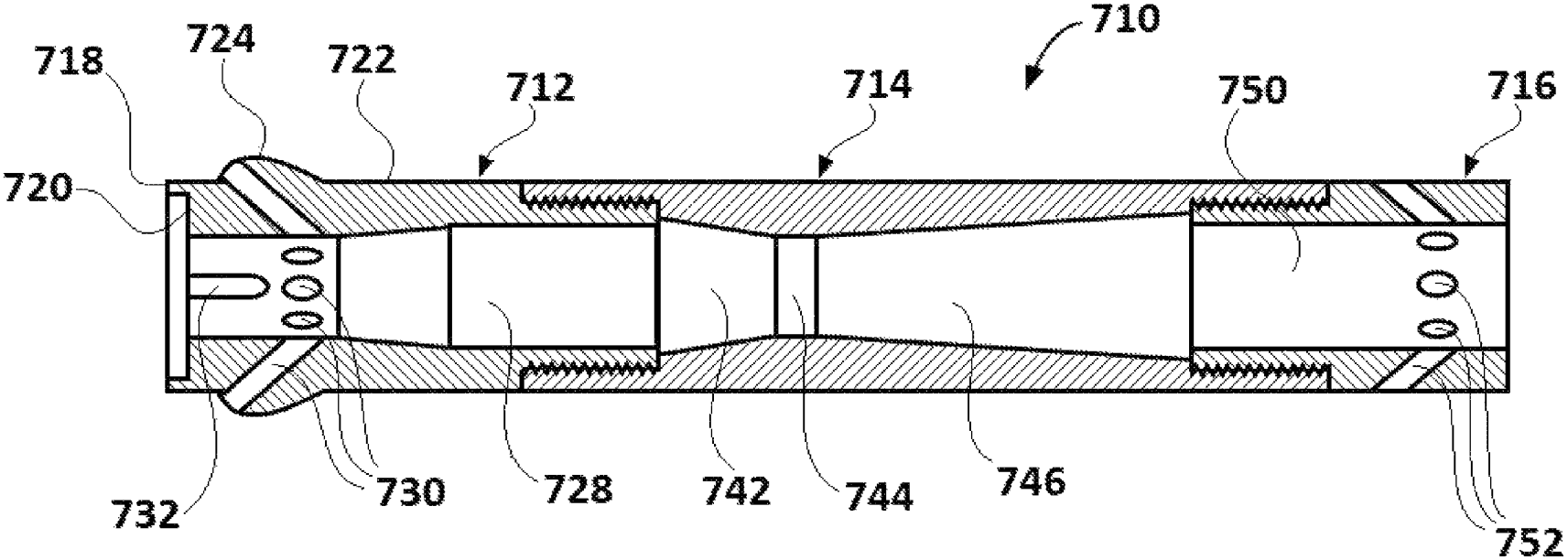

FIG. 13 illustrates a longitudinal cross-section of yet another embodiment of the assembled axial channel flow regulator valve of FIG. 6. As shown in FIG. 13, the assembled axial channel flow regulator valve 710 composed of three components: an upper mini-sub 712, a central mini cylinder 714 and a lower mini-sub 716.

The upper mini-sub 712 includes an upper end 718, strike seat 720, a cylindrical portion 722, an annular bulge 724, an internal flow channel 728, plurality of converging flow channels 730 and two channel extension arms 732 (only one being visible in FIG. 13). The channel extension arms 732 are similar to the arms 332 shown in FIGS. 6 and 7A-7C. The channel extension arms 732 are extensions of flow channel 728 interconnecting it to strike seat 720. The channel extension arms 732 are positioned opposite to each other on the periphery of flow channel 728. Orientation of channel extension arms 732 are similar to those of arms 332 illustrated in FIGS. 7A-7C. The annular bulge 724 lies proximal to the upper end 718 and surrounds the cylindrical portion 722. As shown in the figures, flow channels 730 are spread symmetrically around internal flow channel 728, and each flow channel 730 runs through the bulge 724 to interconnect the exterior of the upper mini-sub 712 with the internal flow channel 728. Structurally, The internal flow channel 728 is similar to the arms internal flow channel 328 shown in FIGS. 6 and 7A-7C.

The central mini cylinder 714 includes an upper internally threaded end 734, a lower internally threaded end 736, a central cylindrical portion 738, a converging flow channel 742, a constant channel 744 and a diverging flow channel 746. As compared to corresponding portions of the assembled axial channel flow regulator valve 310 of FIG. 6, the converging flow channel 742 is wider and of a shorter axial length, and the diverging flow channel 746 is wider and of a longer axial length. The constant channel 744 is wider but of a shorter axial length than that of the constant channel 344 of the assembled axial channel flow regulator valve 310. Flow channels 730 and 752 are similar to corresponding flow channels 330 and 352 of the assembled axial channel flow regulator valve 310.

The foregoing description and embodiments are intended to merely illustrate and not limit the scope of the invention. Other embodiments, modifications, variations and equivalents of the invention will be apparent to those skilled in the art and are also within the scope of the invention, which is only described and limited in the claims which follow, and not elsewhere.

What is claimed is:

1. A fluid driven pulsating, hammering tool operational when pressurized fluid is pumped into an upper sub of said tool, comprising:

a poppet valve having a valve seat which can seal the upper end of a slidable outer valve assembly when closed, thereby generating back pressure waves in the pressurized fluid which intermittently reduce the fluid pressure in the poppet valve such that it intermittently opens the valve seat;

an inner valve assembly slidable within the outer valve assembly;

wherein the inner and outer valve assemblies remain in selective fluid communication with the poppet valve even when the poppet valve is closed, wherein interruption of said fluid communication occurs from movement of the inner and/or outer valve assemblies to particular positions along their sliding paths, such that said interruption also generates back pressure waves in the pressurized fluid which intermittently reduce the fluid pressure in the poppet valve;

further including an axial channel flow regulator valve having a fluid flow channel including a converging flow channel and a diverging flow channel, the axial channel flow regulator valve further including a first set of converging flow channels proximal to the upper end of the axial channel flow regulator valve and a second set of diverging flow channels proximal to the lower end of the axial channel flow regulator valve, the first set and the second set of flow channels fluidically connecting the fluid flow channel with exterior of the axial channel flow regulator valve;

and wherein there is a fluid path from said fluid flow channel directly to the poppet valve, and a second flow path from said fluid flow channel to the inner valve assembly and to the outer valve assembly such that said outer valve assembly can be positioned closed to restrict access from the fluid flow channel to the poppet valve other than through the outer valve assembly, and wherein when positioned closed, the fluid flow channel remains in fluid communication with the inner and outer valve assemblies, and whereby said axial channel flow regulator valve intermittently generates back pressure waves which intermittently reduce the fluid pressure in the poppet valve.

2. The fluid driven pulsating, hammering tool of claim 1 wherein the upper end of a slidable outer valve assembly includes a flow nut to allow fluid pressure access to the outer and inner valve assemblies.

3. The fluid driven pulsating, hammering tool of claim 2 wherein the valve seat can seal the upper end of a slidable outer valve assembly by sealing the flow nut.

4. The fluid driven pulsating, hammering tool of claim 1 wherein (i) the fluid flow path from said fluid flow channel directly to the poppet valve, and (ii) the selective fluid communication between the inner and outer valve assemblies with the poppet valve, are both partly defined by an inner side of an outer barrel which connects the upper sub with a lower sub.

5. The fluid driven pulsating, hammering tool of claim 1 wherein positioning the outer valve assembly closed also restricts fluid communication between the inner valve assembly and the poppet valve.

6. The fluid driven pulsating, hammering tool of claim 1 wherein positioning the inner valve assembly closed does not prevents fluid communication between the outer valve assembly and the poppet valve.

7. The fluid driven pulsating, hammering tool of claim 1 wherein said outer valve assembly further includes an upper outer wash pipe attached to the upper side of a vented outer valve and a lower outer wash pipe attached to the lower side of the vented outer valve.

8. The fluid driven pulsating, hammering tool of claim 1 wherein said inner valve assembly further includes an upper inner wash pipe attached to the upper side of a vented inner valve and a lower inner wash pipe attached to the lower side of the vented outer valve.

9. The fluid driven pulsating, hammering tool of claim 1 wherein the upper outer wash pipe and the lower outer wash pipe both have vents.

10. The fluid driven pulsating, hammering tool of claim 1 wherein a valve stem in the poppet valve is surrounded by at least two springs which resist compression in opposing directions, such that compressing one said spring decompresses the other said spring.

11. A fluid driven pulsating, hammering tool comprising:

a poppet valve having an upper chamber within an upper sub, said upper chamber including one or more vents passing through an upper chamber wall and said poppet valve having a lower chamber surrounded by a lower chamber wall, wherein a valve stem extends from the upper chamber through a divider and into the lower chamber, and a valve seat resides in the lower chamber, and wherein the portion of the valve stem in the upper chamber is surrounded by at least one spring positioned between the uppermost end of the valve stem and the upper side of the divider, and the portion of the valve stem in the lower chamber is surrounded by at least one spring positioned between the lower side of the divider and the valve seat;

the lower chamber wall has an exterior side which is adjacent to an inner side of a wall of an outer barrel, wherein the outer barrel wall connects the upper sub to the lower sub and an outer barrel chamber lies within the inner side of the wall of the outer barrel;

an outer valve assembly with an interior and an exterior, said outer valve assembly slidable axially within an interior channel having an interior channel wall which is positioned adjacent the inner side of the wall of the outer barrel such that the outer barrel chamber is restricted to the space between the exterior of the interior channel wall and the inner side of the wall of the outer barrel, and wherein said one or more vents passing through the upper chamber wall are in fluid communication with the outer barrel chamber;

said outer valve assembly further includes an upper outer wash pipe attached to the upper side of a vented outer valve and a lower outer wash pipe attached to the lower side of the vented outer valve, and wherein the poppet valve stem can be positioned such that the valve seat seals the upper end of the upper outer wash pipe;

an inner valve assembly with an interior and an exterior, slidable within the outer valve assembly, said inner valve assembly including an upper inner wash pipe attached to the upper side of a vented inner valve and a lower inner wash pipe attached to the lower side of the vented inner valve;

wherein the inner and outer valve assemblies can be positioned to provide a fluid flow path from the interior of the outer valve assembly and optionally also from the interior of the inner valve assembly, through the interior channel wall and to the outer barrel chamber;

an axial channel flow regulator valve having a fluid flow channel including converging flow channel and a diverging flow channel, the axial channel flow regulator valve further including a first set of converging flow channels proximal to the upper end of the axial channel flow regulator valve and a second set of diverging flow channels proximal to the lower end of the axial channel flow regulator valve, the first set and the second set of flow channels interconnecting the fluid flow channel with exterior of the axial channel flow regulator valve;

and wherein said outer valve assembly can be positioned closed to restrict access from the fluid flow channel to the outer barrel chamber other than through the interior of the outer valve assembly and then through the interior channel wall, and wherein when positioned closed, the channel remains in fluid communication with the interiors of the inner and outer valve assemblies.

12. The fluid driven pulsating, hammering tool of claim 11 wherein the upper end of a slidable outer valve assembly includes a flow nut to enhance fluid pressure flowing through the outer and inner valve assemblies.

13. The fluid driven pulsating, hammering tool of claim 12 wherein the valve seat can seal the upper end of a slidable outer valve assembly by sealing the flow nut.

14. The fluid driven pulsating, hammering tool of claim 11 wherein the upper outer wash pipe and the lower outer wash pipe both have vents.

15. The fluid driven pulsating, hammering tool of claim 11 wherein said interior channel wall has at least one set of vents.

16. The fluid driven pulsating, hammering tool of claim 11 wherein the divider and valve seat both have flow channels therein.

17. The fluid driven pulsating, hammering tool of claim 11 wherein the vented outer valve has regions of different outer diameters.

18. The fluid driven pulsating, hammering tool of claim 11 wherein the valve seat, the vented outer valve and the vented inner valve are made of an aluminum bronze alloy.

19. The fluid driven pulsating, hammering tool of claim 18 wherein the aluminum bronze alloy is 85% Cu, 10.80% Al, 3.67% Fe, 0.42% Mn and 0.11% Ni.

* * * * *